United States Patent [19]

Wasylyk

[11] 4,244,657

[45] Jan. 13, 1981

[54] FONT AND METHOD FOR PRINTING CURSIVE SCRIPT

[75] Inventor: Thomas M. Wasylyk, Honesdale, Pa.

[73] Assignee: Zaner-Bloser, Inc., Columbus, Ohio

[21] Appl. No.: 913,564

[22] Filed: Jun. 8, 1978

[51] Int. Cl.[3] ..... B41J 3/06

[52] U.S. Cl. ..... 400/109; 400/16; 400/19; 400/65; 101/399

[58] Field of Search ..... 400/16, 19, 65, 109–111; 101/398, 399

[56] References Cited

U.S. PATENT DOCUMENTS

| | | | |
|---|---|---|---|
| 1,563,265 | 11/1925 | Dixon | 101/399 |
| 2,940,575 | 6/1960 | Khalil | 400/111 |
| 3,111,646 | 11/1963 | Harmon | 340/146.3 AQ |
| 3,513,968 | 5/1970 | Hanson | 400/111 |
| 3,938,099 | 2/1976 | Hyder | 400/19 |
| 3,998,310 | 12/1976 | Chaudhry | 400/111 |
| 4,024,500 | 5/1977 | Herbst | 340/146.3 SG |

FOREIGN PATENT DOCUMENTS

| | | | |
|---|---|---|---|
| 89252 | 5/1920 | Fed. Rep. of Germany | 400/109 |
| 2319491 | 2/1977 | France | 400/111 |
| 728158 | 3/1955 | United Kingdom | 400/109 |
| 1176523 | 1/1970 | United Kingdom | 400/111 |

*Primary Examiner*—William Pieprz
*Attorney, Agent, or Firm*—Robert B. Watkins

[57] ABSTRACT

A font of alphabetical letters is disclosed herein which is to be employed for the printing of cursive writing script. The font is characterized by the fact that all of the letters are formed to combine with sets or subsets of individual letters of the font. The combination is by connecting each letter at the front or rear with a ligature in which it is indistinguishable that the letters are separately formed in the font. The method of printing is disclosed by which a letter of the font may be selected to indistinguishably connect in ligature with the preceding and following letters so that the printed cursive script is acceptable in appearance, and equal in form to cursive writing examples that represent the accepted standards of correct penmanship.

10 Claims, 13 Drawing Figures

| TYPE | LEADER | CHARACTERS |
|---|---|---|
| DOWN CURVE | | a d g q |
| MINIMUN UNDERCURVE | | i j p r s t w w |
| STEEP DOWN CURVE | | o c |
| OVERCURVE | | m n v x y z |
| MAXIMUN UNDERCURVE | | b f h k l |
| SHORT UNDERCURVE | | e |
| CHECK STROKE | | e |

| TYPE | LEADER | CHARACTERS |
|---|---|---|
| DOWN CURVE | | a d g q |
| MINIMUN UNDERCURVE | | i j p r s t u w |
| STEEP DOWN CURVE | | o c |
| OVERCURVE | | m n v x y z |
| MAXIMUN UNDERCURVE | | b f h k l |
| SHORT UNDERCURVE | | e |
| CHECK STROKE | | e |

Mr Richard H. Bell 63 64

FONT AND METHOD FOR PRINTING CURSIVE SCRIPT

BACKGROUND OF THE INVENTION

Early in the formation of written communication techniques, when each character or letter was formed by a writing instrument in the hand of the writer, it became apparent that connecting one character or letter to the next with continuous stroking of the writing instrument without lifting the instrument from the substrate, greatly increased the speed and continuity of the printing process. Since in these earlier times the printing press and other now well known methods and apparatus for printing were unknown, each copy of a communication from the first to the last had to be made by individually taking the time to create each letter or character on the substrate or written material. The time saved by writing in cursive script, i.e. with one letter connected to the next, was very important. To this day most people can perform their individual scriven words faster and with greater ease when writing in script rather than by hand lettering unconnected letters or characters in manuscript.

With the development of the printing process, however the speed and facility for multiple copies reversed the emphasis and desirability of connecting letters and characters together. In the printing process from its early days to the present, letters and characters standing alone and unconnected from one to the next make the formation of the "master" much quicker and easier (whether it be set in metal type or created by photographic lithography or other technique).

This will be apparent from the fact that in "setting print," a term commonly used to define the establishment and creation of the printing master, the individual letters are selected from a supply or font containing one or more of each individual letter, character, or representation. Letters and characters which stand alone are much more easily selected and positioned in setting print. Since there is no loss in communication between lettered material and cursive written material, it has been the natural evolution that material intended to be printed seldom takes the form of cursive writing.

Today only a very small portion of the material which people read is in the form of cursive writing for the reasons stated above. Nevertheless, the individual person may still have the benefit of cursive writing when he or she is individually and personally creating scriven material. For this reason, and perhaps for reasons of tradition and a sense of the esthetic, cursive writing and penmanship is still taught and has been continuously taught with varying degrees of emphasis in the schools of the United States and the rest of the world.

The typical methods of teaching penmanship include instructing the pupils in the imitation of sample cursive written letters and characters. The sample letters and characters are those either produced by the teacher, which he or she learned by the same method of imitation, or those provided in textbooks and workbooks provided to the teacher and pupils by the publishing industry. For the most part penmanship is taught by the latter example, that is by the use of textbooks and workbooks.

The method and apparatus of this invention greatly improves and facilitates the printing of workbooks and textbooks and other materials where cursive script is to be printed by modern techniques of typesetting, including those methods known as photo typesetting. This invention in combination with computerized photo typesetting techniques may make the printing of cursive script simple enough that the trend to individual letter print may be reversed in favor of the esthetically pleasing and traditional style of cursive writing.

In the past in the United States two different methods of cursive script penmanship have predominated. These are the Zaner-Bloser and the Palmer Method. These methods take their names from the originators who by their hand created a style of writing letters and characters that came to be the accepted standards for teaching penmanship in the schoolrooms of the country. The Zaner-Bloser method has been taught by means of copied examples and photographic reproduction plates until this invention. The publisher of workbooks and textbooks prescribing the Zaner-Bloser method has relied on the skill of its employees which originated with the original creator of the penmanship style.

In the manuscript (printed letters) alphabet there are 26 lower case letters and 26 upper case letters as well as extra characters such as apostrophes, quotation marks, hyphens, etc. Since none of the letters or characters are connected to the adjacent one, each letter or character can be associated with each one of the other letters or characters.

On the other hand, in cursive writing, and particularly with the accepted standard of Zaner-Bloser penmanship, the letters are connected with a variety of ligatures. This variety of ligatures in acceptable penmanship and the complexity of type required to produce good ligature in the printing process has not been solved in the prior art.

The problems of acceptable ligature in the printing processes for cursive script have been approached in the prior patent art, but applicant is not aware of any patents addressing the problem of printing cursive writing using the letters of the English language and derivations. Patents of related general interest include U.S. Pat. No. 714,621, U.S. Pat. No. 3,699,518, and U.S. Pat. No. 3,111,646. U.S. Pat. No. 4,024,500 approaches the problem of ligature by adapting the characters and script to meet on a common line of ligature which is at the median or middle point of the character. Script writing typewriters produce a cursive script in which the difficult ligatures are omitted and the cursive written material does not take the form of acceptable penmanship as taught for the Zaner-Bloser or the Palmer Method. Apparently prior attempts toward the printing of cursive writing have been to adapt a penmanship to the necessities of the printing technique rather than adapt the printing techniques to the object of producing acceptable penmanship.

SUMMARY OF THE INVENTION

In this invention a font of alphabetical letters, both upper case and lower case, as well as associated characters such as Arabic numerals, minus signs, plus signs, equal-to-signs, punctuation marks, etc. is constructed in which the letters and characters associate with adjacent letters and characters in a form and ligature which produces by the printing process substantially correct and acceptable Zaner-Bloser cursive script penmanship. The font is carried out by creating a subset of letters and characters for each letter of the alphabet. In each subset there are those letters which connect to the preceding letter with correct ligature as defined by the cursive writing methods being printed.

Correct ligature is defined for purposes of the description of this invention to be a connection between letters that are properly spaced, in which the end of the preceding letter and the beginning of the succeeding letter overlap or touch with a curvature, height, and slope so that the point and area of contact is indistinguishable in the printed cursive script. This is accomplished by connections that are in registry at intersections, and by overlaps at blend points which are substantially tangent at the point of connection and throughout the ligature. This connection in the ligature, being at a point or points of tangency, is indistinguishable in the printed cursive script that results from the use of the font.

With the use of this font any material comprising the letters and characters of the English alphabet and used for printing the English and other romance languages may be printed with accepted standards of correct penmanship of cursive writing or script.

DETAILED DESCRIPTION OF THE INVENTION

The cursive font of this invention contains the characters of the English alphabet, as well as various associated signs, symbols, and punctuation marks, etc. that are customarily used with them. Many of these characters are used with other Romance languages, i.e. those having a connection to Latin. Arabic numerals are included as usual with the English alphabet.

Figure 1:
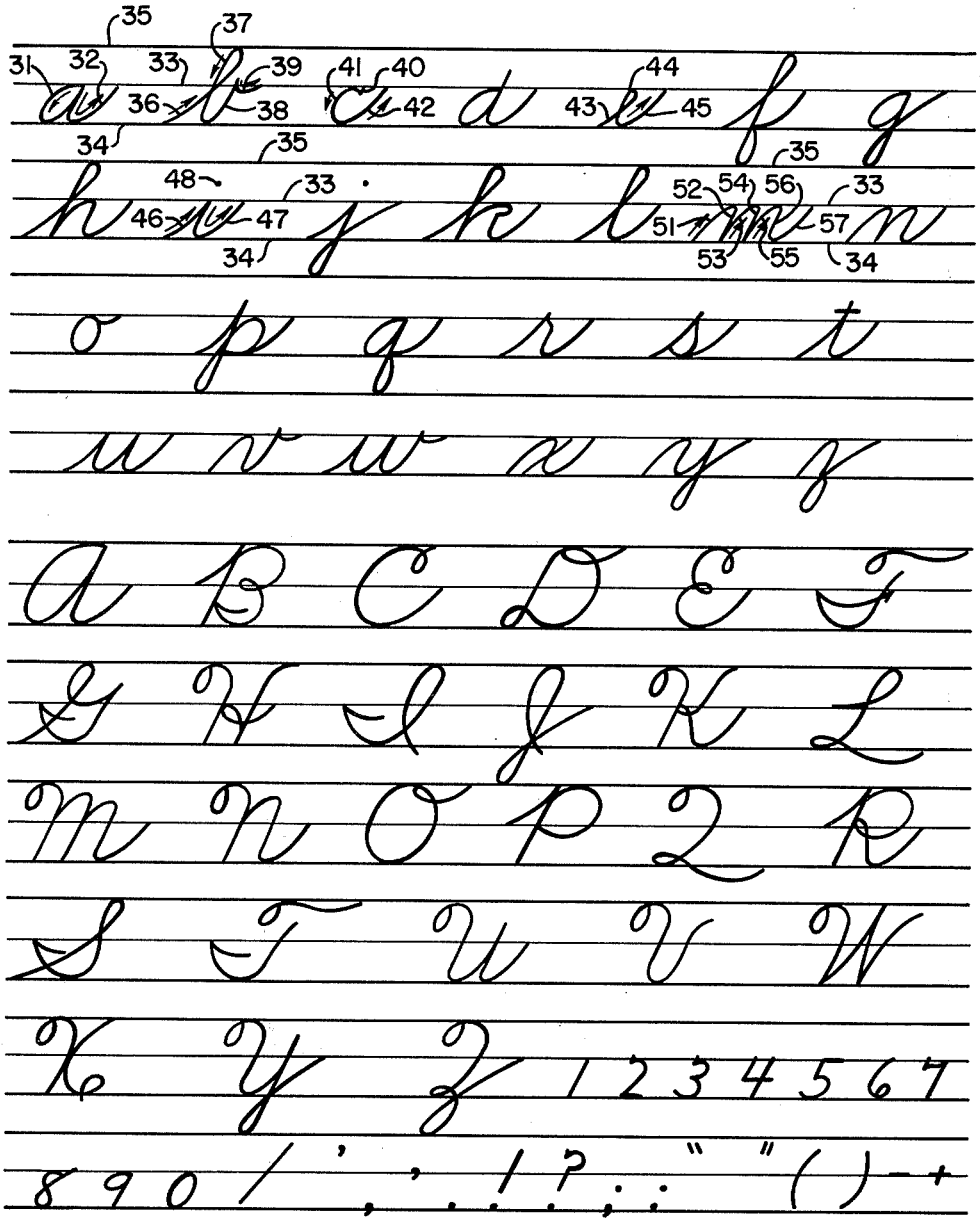
FIG. 1 is an elevation view of the basic characters of the font comprising this invention.

In FIG. 1 the form of the basic characters of the cursive font, including the letters of the alphabet, as well as numerals, signs, symbols, and punctuation marks is shown. Those shown are typical of the cursive characters used and taught in the schools of the United States and many other countries of the world. However, as previously described, there are at least two most recognized standard forms of cursive writing which are referred to as methods. These are the Zaner-Bloser or the Palmer Method. The character forms shown in FIG. 1 represent the Zaner-Bloser cursive characters. There is little different between the Zaner-Bloser and the Palmer forms of characters in the basic alphabet.

Correct stroking is considered very important in creating good and correct cursive writing. The lower case letter a, in FIG. 1, is properly formed by a first stroke 31 which is termed a "downcurve" in the direction of the arrow. This is continued into a loop which is followed by the second stroke 32 coming down at a slant and curving up to meet the mid line 33, which is located between the base line 34 and the head line 35.

The letter b starts with a "maximum undercurve" stroke 36, followed by a loop stroke 37 descending at a slope to a sharp undercurve 38, and a check stroke 39.

The letter c begins with a "steep downcurve" 41, after a slight touch-down 40, followed by a curve 42 back to meet the mid line 33.

The letter e begins with a short "undercurve" 43 followed by a loop 44 and an under curve 45 back to the midline 33.

The letter i begins with a "minimum undercurve" 46 followed by a slant stroke and under curve 47 to the mid line 33. A dot 48 is placed halfway between the mid line 33 and the head line 35.

The letter n begins with an "overcurve" 51, followed by a slant stroke 52 to the base line and repeated overcurves with slant strokes twice more 53, 54 and 55, 56. This is followed by a curve 57 to the mid line 33.

As described above, each of the letters a, b, c, e, i and m begin with a different basic stroke. All of the letters of the basic alphabet, lower case, begin with one or the other of the basic strokes represented by these letters. It will be seen that the distinctions between the downcurve stroke 31 of the letter a and the steep downcurve stroke 41 of the letter c are not very great. The same is true for the maximum undercurve stroke 36 of the letter b and the minimum undercurve stroke 46 of the letter i. Nevertheless, these distinctions are very important in the creation of correct cursive writing.

It will be understood that the base line 34, the mid line 33 and the head line 35 are construction lines only, and are for training and understanding. They do not appear in the final writing, and printing.

When words are formed from the letters of the cursive alphabet, most are connected to the letter preceding and the letter following. In the most accepted forms of penmanship, the writing instrument does not often rise in a word from contact with the substrate, usually paper, on which the writing is taking place. It is the smooth stroking and flowing of the writing motion which allows for speedy writing while preserving the aesthetic pleasing appearance. In writing when the letters are connected together to form words, the connection strokes are smoothly made. Unless analyzed with great particularity, the ending of the preceding letter and the beginning of the succeeding letter is indistinguishable to the reader, when normally viewed with the naked eye.

Figure 2:
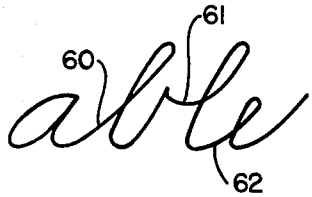
FIG. 2 is an elevation view of a word of cursive script that could be printed with the font of this invention.

In FIG. 2, an example of a written word is shown with the connections, often termed ligatures, 60, 61 and 62, smoothly stroked and indistinguishable as to the beginning and ending of the various individual letters.

The printing process, in its various forms uses a font of previously formed characters which are placed one beside another in succession to form words. In manuscript lettering, relative position of the succeeding letters is a relatively simple matter, being one of position in the vertical direction and spacing in the horizontal direction. However in printing cursive script bringing together of the end of the preceding letter with the beginning of the succeeding letter to produce the indistinguishable ligatures shown in FIG. 2 requires a uniquely conceived font of characters which indistinguishably connect.

Figures 3, 4, 13:
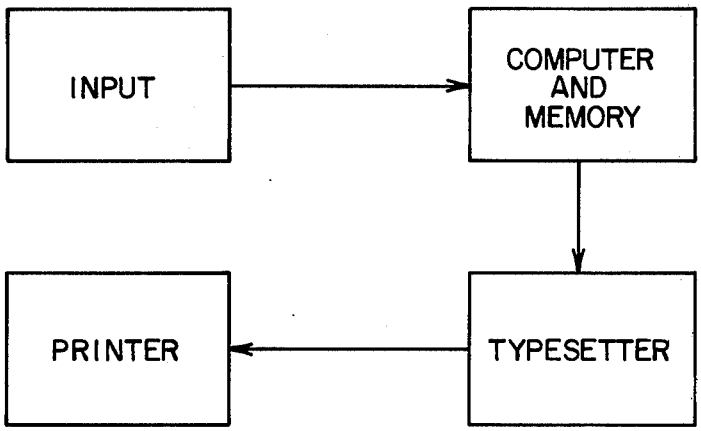
FIG. 3 is a chart of the various letters and connectors used for ligature in the font of this invention.
FIG. 4 is an elevation view of cursive written words that could be printed by the font of this invention.
FIG. 13 is a flow diagram of a process using the font and method of this invention.

The font of this invention includes a character previously formed with an ending to match every beginning form of letters that are connected in writing with the English alphabet. In the chart of FIG. 3, all of the forms of letters that must be connected to by a preceding letter are shown and grouped by the type of beginning stroke of the letter. The font contains a letter, or character, if it is one requiring connection, that has an ending which will indistinguishably overlap or contact the kind of letter classified in FIG. 3.

Figure 11:
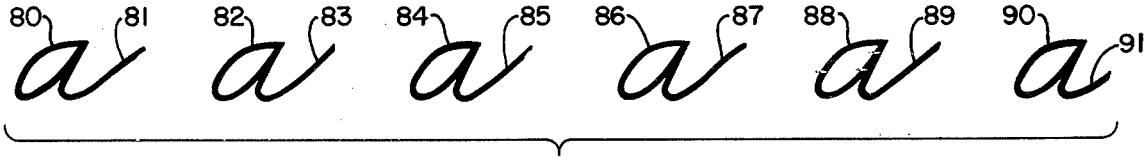
FIG. 11 is an elevation view of the subset "a" of the font of this invention.

In the font all of the same letters, are included in subsets. The subset for the letter a is shown in FIG. 11. The letter a 80 is formed with the connector 81 for a ligature with letters that begin with a downcurve. In FIG. 11, the letter a 82 is formed with a connector 83 for a ligature with letters that begin with a minimum undercurve. Letter a 84 of the subset is formed with a connector 85 for a ligature with a letter that begins with a steep downcurve. Letter a 86 of the subset is formed with a connector 87 for a ligature with letters that begin with an overcurve. Letter a 88 of the subset is formed with a connector 89 for a ligature with a letter that begins with a maximum undercurve. Letter a 90 of the subset is formed with a connector 91 for a ligature with the letter e that begins with a short undercurve.

Thus it will be seen that the subset of the letter a contains all of the connections required to make all the ligatures necessary to produce indistinguishable connections in ligature when the font is used in printing.

The detailed description above of the subset a, is intended to typically describe a subset. It will be obvious that the subsets of the font for the other letters of the alphabet are similarly formed.

In some methods of cursive writing, such as the Zaner-Bloser, certain upper case letters always stand alone. The remaining ones of the alphabet are connected to the succeeding letters when it is a lower case letter.

In FIG. 4 an example of typical lower case and upper case cursive writing is shown. It will be seen that the upper case M is connected to the lower case r at the ligature 63. In the same fashion the upper case R is connected to the lower case i in the ligature 64. On the other hand, the upper case H and upper case B stand alone and are without connection.

The upper case letters that connect to lower case letters at the beginning of a word are A, C, E, H, J, K, M, N, R, U, Y & Z. In the font of this invention there is a subset of upper case letters for each of the just listed letters. Each subset includes a character form that will indistinguishably connect to each of the beginning form letters shown in FIG. 3.

For instance, in the font there is a letter form upper case A which is provided with an ending that is adapted to connect to the downcurve beginning of a, d, g, q, and this comprises one subset. In the subset of the upper case letters there is a letter A that has an ending formed to indistinguishably connect to those letters beginning with a minimum undercurve such as i, j, p, r, s, t, u or w. In like manner there is in the subset a letter A for each of the other beginning stroke conditions, i.e. steep downcurves, overcurve, maximum undercurve, and short undercurve e.

In the font there is a subset of word ending strokes, adapted to fit each one of the letters as required. Alternatively, a letter form with a word ending stroke may be added to each subset of connectable letters.

In the second column of the chart of FIG. 3 are shown leader stroke characters. The font contains a leader stroke character for each other kind of letter shown in the chart; except, a, d, g, q and o or c. These letters start a word in their basic form. The other letters use a leader stroke character when they begin a word.

For every connectable letter of the alphabet, the font contains a letter form that will indistinguishably connect to a downcurve letter such as a, d, g, and q. These are shown on the second line of the chart.

On successive lines of the chart it is shown that; for every connectable letter of the alphabet, the font contains a letter that will indistinguishably connect in ligature with the minimum undercurve letters, on the third line of the chart, i, j, p, r, s, t, u, w.

In anologus formation, there are letters to connect with the steep downcurve letters o and c. There are also letters to connect with the overcurve beginning letters m and v, x, y, and z. In addition there are letters to connect with the maximum undercurve beginning letters b, f, h, k and l.

There are also letters to connect with the letter e. In writing, the letter e has two different beginnings. The "short undercurve" e and the "check stroke" e. However the total number of letters of the font for connection to the letter e comprises only one complete alphabetical sequence, since each other letter of the alphabet connects with the letter e in one way or the other way, i.e. either by short undercurve or by check stroke.

In order that there be clear understanding of the indistinguishable connection and ligature, an enlarged view of each of the connection conditions has been provided.

Figure 5:
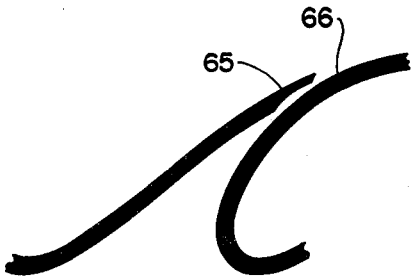
FIG. 5 is an enlarged elevation view of the connection to a downcurve formed letter of the font of this invention.

In FIG. 5, the letter a with a subset ending to connect to a downcurve beginning of another letter a is shown. When the two letters are connected, the end of the preceding letter connector 65 lays upon the downcurve portion 66 of the succeeding letter in a position substantially tangent to the curve of the downstroke portion so that the connection is indistinguishable.

For clarity in FIGS. 5, 6, 7, 8, 9, and 10, the connectors are shown slightly apart from their correct position of indistinguishable connection in ligature. When the font is used the letters are brought together by horizontal movement until the connector of the preceding letter overlaps the beginning stroke of the succeeding letter.

Figure 6:
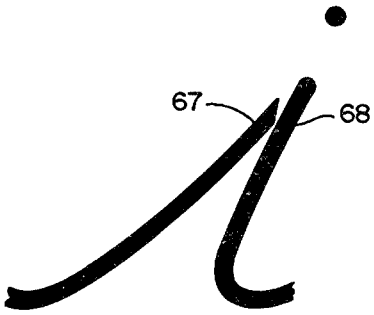
FIG. 6 is an enlarged elevation view of the connection to a minimum undercurve formed letter of the font of this invention.

In FIG. 6, the letter a of the subset which has the connector for minimum undercurve 67 is shown in position adjacent to contact with the slant stroke 68 of the letter i.

Figure 7:
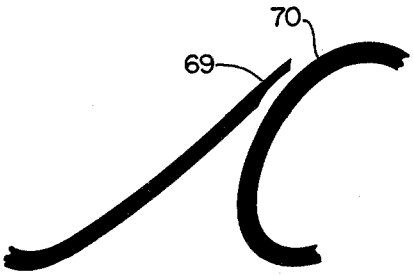
FIG. 7 is an enlarged view of the connection to a steep downcurve formed letter of the font of this invention.

In FIG. 7, the letter a of the subset with the connector 69 for the steep downcurve beginning stroke 70 of the letter o is shown.

Figure 8:
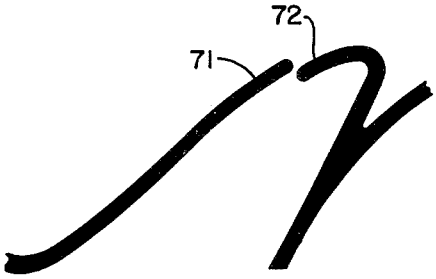
FIG. 8 is an enlarged elevation view of the connection to an overcurve formed letter of the font of this invention.

In FIG. 8, the letter a of the subset with the connector 71 for an overcurve beginning stroke 72 of the letter m is shown.

Figure 9:
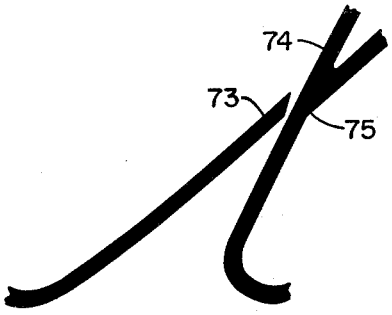
FIG. 9 is an enlarged elevation view of the connection to a maximum undercurve formed letter of the font of this invention.

In FIG. 9, the connector for a letter having a beginning stroke of maximum undercurve is shown with a beginning stroke connector 73 in place for intersection with the slant stroke 74 of the letter b at the intersection 75 of the upper loop.

Figure 10:
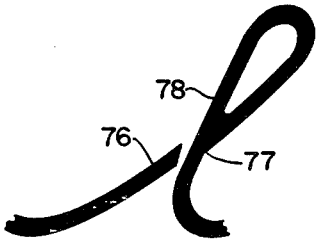
FIG. 10 is an enlarged elevation view of the connection to the short undercurve form of the letter e in the font of this invention.

In FIG. 10, the letter a of the subset is shown having the ending 76 adapted to meet with the short undercurve type of letter e at the point of intersection of the loop 77 on the down stroke 78.

In the font of this invention, which is constructed to print Zaner-Bloser cursive writing, there are 26 basic lower case letters of the alphabet and 26 basic upper case letters of the alphabet. In addition there are 39 subsets for connections. Also there are 43 extra characters including ten numerals and punctuation marks.

In a font constructed according to this invention, but which was made to print a different method of cursive writing, the number would perhaps be different.

In one embodiment of this invention, the font is used in a phototype setting apparatus. Typical apparatus of this kind is shown in U.S. Pat. No. 3,434,402.

In the printing process using the font of this invention, the font of character forms is retrievably stored in a magazine. The magazine, in the preferred embodiment, is a photographic negative upon which each character of the font has been photographically impressed. The negative may be in a roll form so that all of the characters of the font are sequentially disposed thereon. It could also be in a grid or matrix form.

In the process using the roll form, the various sequential letters are selected by indexing the negative roll to find the correct letter that is formed to connect the preceding letter and the succeeding letter indistinguishably. As a matter of procedure, the font is indexed to the position of the subset after which it is indexed within the subset to select the letter that is formed to connect with the following letter.

It will be seen that the selection of a letter to indistinguishably connect with the preceding letter must encompass a recognition of the next following letter. The criteria for selection are that the letter fit the preceding letter and that it also has an ending that will fit the following letter.

Figure 12:
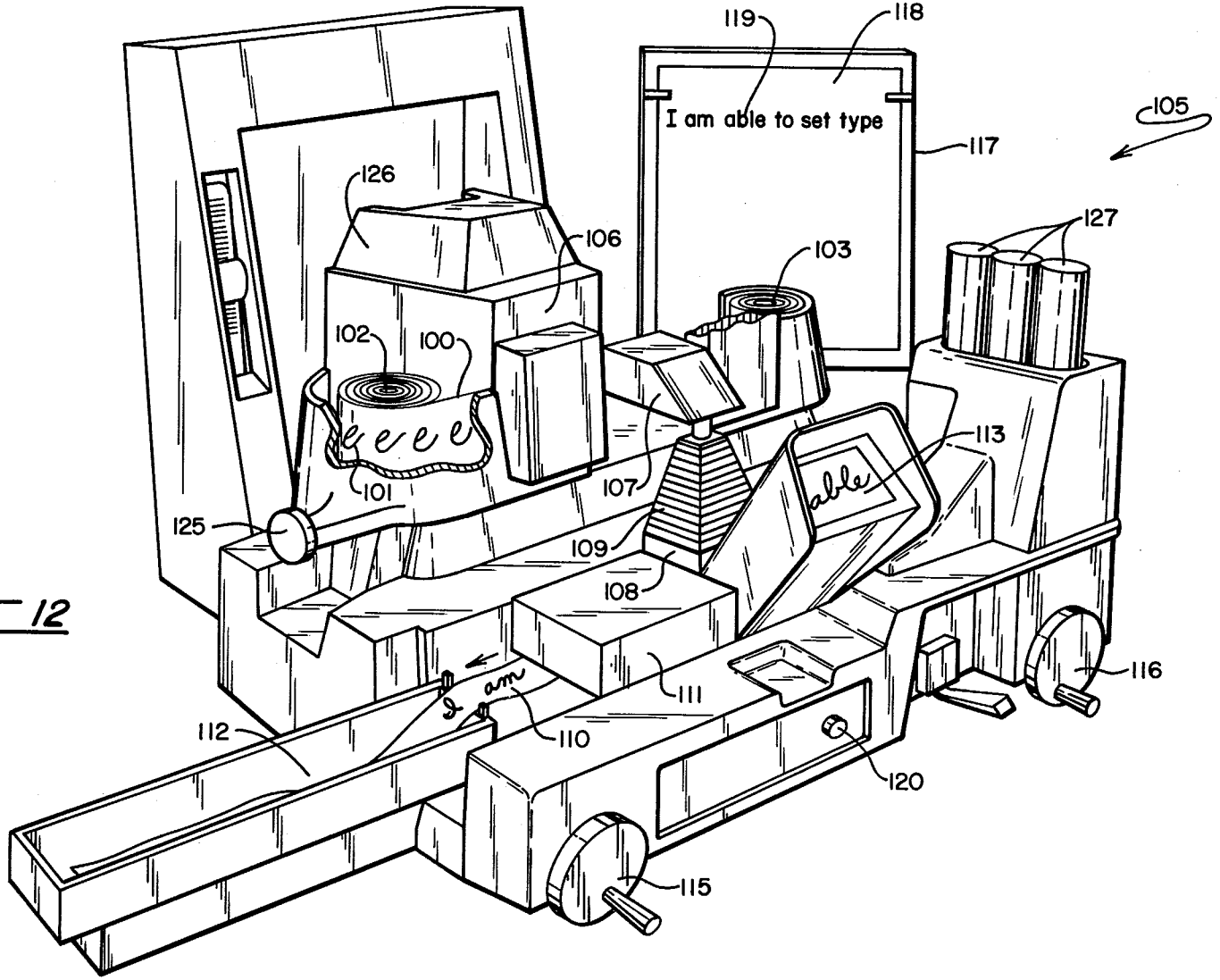
FIG. 12 is a schematic prospective view of phototypesetting apparatus having the font of this invention.

Typical phototypesetting apparatus is shown in FIG. 12 in which the negative film 100 having subsets of letters and characters, typically e 101, is spread between rolls 102 and 103.

The apparatus in general 105, comprises a projector system in a housing 106 which projects the characters 101 through an optical system 107 to a positioning station 108 inside and beneath the bellows 109. Passing through the positioning station 108 is a printed substrate 110 which emerges from a developer station 111. The substrate 110 is made of light sensitive material, and after development in station 111 it passes into a fixer bath 112. By suitable optics, observation of the positioning station 108 is provided on a viewing screen 113. The cranks 115, 116 are operatively connected to reels 102 and 103, respectively, and are used to traverse the font film 100 in either direction.

The apparatus 105 shown in FIG. 12, is a typical configuration and construction that may be purchased from one or more suppliers in the commercial marketplace.

In operation, an operator, not shown, is positioned in front of the apparatus 105 with a convenient view of the viewing screen 113 and an easel 117 which holds the manuscript 118 on which is presented the material, in words and sentences, to be set in type and printed. The operator turns the cranks 115, 116 and traverses the font film 100. This positions the optical projection of the letters from the film 100 on to the substrate 110 at the positioning station 108. When a letter 101 is properly positioned an exposure switch among the controls 120 is activated by the operator, which photographically impresses the projected image of the letter 101 upon the substrate 110.

Following exposure, the substrate 110 is developed at the position of the exposed letter which then appears on the viewing screen 113 as a printed letter. Substrate 110 is then automatically indexed. The operator then observes the next letter of the manuscript material 118 and traverses the font film 101 until that succeeding letter is in proper position with respect to the preceding letter on the viewer 113. In making the proper selection of the succeeding letter, the operator traverses the film font to the subset which contains the required letter and then selects from the subset the appropriate letter with an ending that will connect indistinguishably in ligature with the following letter that is visible on the manuscript. When the proper letter has been selected and positioned, the control 120 is operated to expose the succeeding letter on the substrate. After exposure, development of the succeeding letter takes place and it is indexed to the preceding letter position. The above described process is repeated successively to print upon the substrate 110 cursive script having the features previously described of this invention.

The substrate 110 proceeds into the fixing bath 112, and after washing, emerges available for use in printing workbooks, text books, and other reading material.

The apparatus 105 contains other normal features such as a focusing knob 125, a lamp house 126, reservoirs of photographic development chemicals 127, etc., which are not a part of this invention.

In a still further embodiment of this invention shown in FIG. 13, typesetting of cursive script with the font and method of this invention is carried out by computerized typesetting equipment. In this, a typical keyboard operated INPUT terminal is connected to a COMPUTER AND MEMORY containing a description of all the letters in every set and subset of the font of this invention. The COMPUTER AND MEMORY provides a signal to the TYPESETTER equipment which traverses the font and activates the PRINTER to print the proper letter that will connect indistinguishably in ligature with the preceding and following letter of the printed material.

In this embodiment, the INPUT station keyboard is arranged to receive a designation by an operator of the circumstances in the sentence structure in which the letter being selected is found. For instance, the operator inputs the preceding letter, the succeeding letter, and the following letter. In addition, the operator inputs the circumstance of whether the position of the letter is at the beginning, in the middle, or at the end of a word. Also the operator inputs whether the letter required is upper case or lower case. With this typical input, the COMPUTER AND MEMORY selects the appropriate letter from the font sets and subsets.

The font of this invention may be formed on a set of metal types which are disposed in a magazine from which they can be retrieved mechanically or by hand and set in fixed plates. Linotype operation either manual or computer controlled could be constructed with a type magazine having the font of this invention.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

What is claimed is:

1. A font of characters constituting a form of cursive written English alphabet when combined and employed in printing words and sentences and in the teaching of cursive writing, said form of cursive written English alphabet including groups of letter forms having beginning stroke forms that are the same, said font comprising:

(a) a set of individual letter forms impressed upon a substrate and containing individually the basic unconnected forms of the letters of the alphabet; and (b) a plurality of subsets comprising individual letter forms impressed upon a substrate, with each subset containing the same letter of the alphabet on each form, and with each letter form of each subset being the same letter, and having a different connector shaped to meet a different beginning letter form on a following letter to print an indistinguishable connection in ligature with a following printed letter, or having a word ending shape;

the plurality of connectable letters being for use in printed words that are printed by combining the characters of the font.

2. A font according to claim 1 wherein the font additionally contains punctuation marks and symbols used with the alphabet.

3. A font according to claim 1 wherein each letter form in each subset has a a different connector depending on the beginning stroke form in which it connects.

4. A font according to claim 3 wherein the number beginning stroke forms is seven.

5. A font according to claim 4 wherein the letters a, c, g and q have a first beginning stroke form, the letters i, j, p, r, s, t, u & w have a second beginning stroke form, the letters o and c have a third beginning stroke form, the letters m, n, v, x, y, z have a fourth beginning stroke form, the letters b, f, h, k, l have a fifth beginning stroke form, and the letter e has a sixth and a seventh beginning stroke forms.

6. A font according to claim 5 wherein the letters in the subset may be formed with a leader stroke preceding and connected to the beginning stroke form.

7. A font according to claim 5 wherein the letters in the subset have a letter with an ending stroke form added thereto when the letter ends a word in printed cursive writing.

8. A method of printing educationally correct cursive written material having preceding, succeeding and following characters of the English alphabet which are formed from a plurality of groups, of different letters of the alphabet having the same distinctive beginning strokes, comprising:

(a) providing a plurality of discrete letter character forms of the same letter of the English alphabet having connector elements which come to indistinguishably meet with the distinctive beginning strokes of adjacent letters in printed words of the cursive written material, (b) selecting from the plurality of discrete character forms, on the basis of and with discrimination as to the form of the beginning strokes, a succeeding character having an extending character element of matching form with the character that will follow the letter being selected.

(c) positioning said succeeding character form adjacent to said preceding character form with the connector of said preceding character in indistinguishable contacting position on said succeeding character, and (d) successively printing said character forms to produce printed cursive writing with indistinguishable connections in ligature.

9. A method of printing cursive written material according to claim 8 wherein the characters are formed by impression on a substrate of photographic film.

10. A font of characters constituting a form of Zaner-Bloser cursive written English alphabet, when combined and employed in printing words and sentences and in the teaching of educationally correct cursive writing, wherein the characters of the font forming the letters a, d, g, and q have a down curve beginning stroke form, the letters i, j, p, r, s, t, u and w have a minimum undercurve beginning stroke form, the letters o and c have a steep down curve beginning stroke form, the letters m, n, v, x, y, and z have an overcurve beginning stroke form, the letters b, f, h, k, and l have a maximum undercurve beginning stroke form, and the letter e has a short undercurve beginning stroke form and check stroke beginning stroke form; said font comprising;

(a) a set of individual letter forms impressed upon a substrate and containing individually the basic unconnected forms of the letters of the alphabet; and (b) a plurality of subsets comprising individual letter forms impressed upon a substrate, with each subset containing the same letter of the alphabet on each form, and with each letter form of each subset having a different connector shaped to print an undistinguishable connection in ligature with the beginning stroke form of the following printed letter when the plurality of connectable letters are assembled in printed words, or having a word ending shape.

* * * * *